United States Patent [19]

Spira et al.

[11] Patent Number: 5,030,893

[45] Date of Patent: Jul. 9, 1991

[54] WALL BOX DIMMING SYSTEM AND FACE PLATE AND SWITCH ASSEMBLY THEREFOR

[75] Inventors: Joel S. Spira, Coopersburg; Michael J. D'Aleo, Ottsville; Denis P. Darragh, Allentown, all of Pa.

[73] Assignee: Lutron Electronics Co., Inc., Coopersburg, Pa.

[21] Appl. No.: 370,912

[22] Filed: Jun. 23, 1989

Related U.S. Application Data

[63] Continuation-in-part of Ser. No. 40,646, Apr. 21, 1987, Pat. No. 4,893,062.

[51] Int. Cl.[5] ..... H05B 37/02

[52] U.S. Cl. ..... 315/294; 362/30; 362/35

[58] Field of Search ..... 315/291, 133, 132, DIG. 4, 315/295, 294; 362/85, 30, 26, 95

[56] References Cited

U.S. PATENT DOCUMENTS

| | | | |
|---|---|---|---|
| 2,575,820 | 11/1951 | Linton | 362/95 |
| 3,060,347 | 10/1962 | Burski | 315/295 |
| 3,129,691 | 4/1964 | Walker | 362/26 |
| 3,406,475 | 10/1968 | O'Donnell | 362/26 |
| 4,575,660 | 3/1986 | Zaharchuk | 315/295 |
| 4,868,384 | 9/1989 | Franken | 362/95 |
| 4,893,062 | 1/1990 | D'Aleo | 315/291 |
| 4,903,171 | 2/1990 | Livezey | 362/30 |
| 4,924,151 | 5/1990 | D'Aleo | 315/295 |

*Primary Examiner*—Eugene R. LaRoche
*Assistant Examiner*—Amir Zarabian
*Attorney, Agent, or Firm*—Ostrolenk, Faber, Gerb & Soffen

[57] ABSTRACT

A wall box dimming system assembly controls the intensity level of a plurality of groups of lights in accordance with a plurality of preset scenes. A face plate assembly which is coupled to the housing of the wall box dimming system includes a face plate. The face plate is formed of a generally opaque material and has front and rear surfaces. A recess is formed in the face plate, the recess extending from the rear surface of the face plate to near the front surface thereof such that a relatively thin region of material remains adjacent the front surface. A lamp is located adjacent the rear surface of the face plate in the area of the recess. The thickness and opacity of the thin region of material and the intersity of light generated by the lamp are such that light can be seen from a position in front of the front surface of the face plate when the lamp is on.

36 Claims, 13 Drawing Sheets

WALL BOX DIMMING SYSTEM AND FACE PLATE AND SWITCH ASSEMBLY THEREFOR

This application is a continuation-in-part of Ser. No. 40,646, filed Apr. 21, 1987, now U.S. Pat. No. 4,893,062 issued Jan. 9, 1990.

BACKGROUND OF THE INVENTION

The present invention is directed towards a wall box dimming system and more particularly a wall box dimming system of the type which controls the intensity level of a plurality of groups of lights in accordance with a plurality of preset scenes.

Systems which control the intensity level of a plurality of lights in accordance with any one of a plurality of preset scenes are well known. An exemplary system is disclosed in U.S. Pat. No. 4,575,660 incorporated herein by reference which is assigned to the assignee of the present invention. Such systems typically include a control panel for entering information concerning the intensity levels of each scene and for determining which particular scene is presently active (i.e. is presently controlling the intensity of the multiple groups of lights). The control panel will normally include a plurality of slide potentiometers, each of which controls the intensity of a respective group of lights for a respective scene. By way of example, the dimmer system can include four slide potentiometers for each of four different scenes for a total of 16 slide potentiometers. The operator of the dimmer system presets the potentiometer positions, and thereby the dimmer levels, for each scene depending upon the lighting effects desired. The control panel will also typically include four push buttons, each associated with a different scene, for enabling the operator of the system to switch control over the light intensities from scene to scene and a fifth button to enable the operator of the system to turn all lights off. Such systems also include power control electronics for controlling the intensity of the lights in accordance with the information entered into the control panel.

In most prior art systems, the power control electronics are in a module located remotely from the control panel. The control panel will typically be situated at a convenient, easily accessible location such as a wall adjacent a maitre'd station in a restaurant while the power control electronics module will be located at a remote, less easily accessible location such as a closet.

In the present invention, the power control electronics are preferably located in a housing which fits into a standard four gang wall box and the control panel is coupled to the power control electronics assembly. Such a compact unit is highly desirable in terms of cost, limited space requirements and the convenience of mounting the entire dimming system assembly in a standard four gang wall box.

While such wall boxes are relatively wide, their height is relatively small. A control panel having dimensions substantially equal to those of the wall box would be aesthetically unpleasing. For this reason, it is desirable for the height of the control panel to be greater than the height of the standard four gang wall box and that the position of at least some of the control switches which enable the operator of the dimming system to switch control over the dimming levels from scene to scene be located at a position below the bottom of the wall box. The control panel should also be as thin as possible to project a small distance from the wall in which the wall box is mounted.

The slide potentiometers which control the intensity levels of the lights are normally preset and left at a given intensity level for relatively long periods of time. For this reason, access to the control arms of the potentiometers should normally be limited so that the dimming settings are not accidentally changed. To this end, a pivotal window forms part of the control panel and pivots between a closed position wherein the control arms of the potentiometers are covered and an open position wherein the control arms are exposed. When it is desirable to change the position of the potentiometers so as to change the intensity level of a given scene, the window is pivoted into the open position. It is preferable that the window be latched in the open position so that the operator of the dimming system can adjust the lighting levels without having to manually hold the window in the open position.

SUMMARY OF THE INVENTION

The present invention achieves all of the foregoing results utilizing a novel hinge structure, face plate assembly and switch assembly described in detail below.

The hinge structure of the present invention comprises:

a coupling section having a cam surface and a locking surface which intersect at a ridge;

a pivoting section pivotally coupled to the coupling section by a pin and being pivotable about the axis of the pin between a closed position and an open position, an inner surface of the pivoting section sliding along the cam surface as it moves from the closed to the open position until it reaches the ridge and then contacting the locking surface after it moves past the ridge;

the coupling section, the pivoting section and the pin cooperating to cause the inner surface to be biased radially inward toward the axis of the pin in such a manner that the inner surface is first biased into contact with the locking surface and is then biased into locking engagement with the locking surface as the pivoting section is moved from the closed to the open position.

The cam surface is preferably formed along an imaginary cylinder whose central axis is parallel to but spaced from the access of the pin with the result that the inner surface of the pivoting section is biased against the cam surface with a continually increasing force as the pivoting section is moved from the closed to the open position.

The face plate assembly of the present invention comprises:

a support plate having an opening formed therein through which a moveable control member can extend; the support plate including a coupling section having a cam surface and a locking surface which intersect at a ridge;

a window pivotally coupled to the coupling section of the support plate by a pin and being pivotable about an axis of the pin between a closed position, wherein the window covers the opening in the support plate, and an open position wherein the window exposes the opening in the support plate, an inner surface of the window sliding along the cam surface as the window moves from the open position to the closed position until it reaches the ridge and then contacting the locking surface after it moves past the ridge; and the coupling section, the window and the pin cooperating to cause the inner surface to be biased radially inward towards the axis of the pin in such a manner that the inner surface is first biased into contact with the locking surface and is then biased into locking engagement with the locking surface as the window is moved from the closed to the open position.

The present invention is further directed towards a dimming system for controlling the intensity of m groups of lights, m being an integer, each group including one or more lights, the dimming system comprising:

A) an electronics module having dimmer electronics located therein for controlling the lighting level of the m groups of lights in accordance with a selected one of n preset scenes, n being an integer greater than 1, the dimmer electronics including:

1) n groups of m slide potentiometers, each slide potentiometer of a given group controlling the intensity of a respective group of lights; and
2) n switch means, each switch means for causing the intensity of a given group of lights to be determined by that group of slide potentiometers associated with the respective switch means;

B) a face plate assembly coupled to the electronics module, the face plate assembly comprising:

1) a support plate having small m×n slots formed therein, each of the slide potentiometers extending into a respective said slot; the support plate including a coupling section having a cam surface and a locking surface which intersect at a ridge; the support plate also having at least one opening through which the switch means extend;
2) a window pivotally coupled to the coupling section of the support plate by a pin and being pivotable about an axis of the pin between a closed position, wherein the window covers the slots and the slide arms of the potentiometers, and an open position, wherein the window exposes the slots and the slide arms of the potentiometers so that the position of the slide arms of the potentiometers may be adjusted by the operator of the dimmer assembly; an inner surface of the window sliding along the cam surface as the window moves from the open position to the closed position until it reaches the ridge and then contacting the locking surface after it moves past the ridge; and
3) the coupling section, the window and the pin cooperating to cause the inner surface to be biased radially inward toward the axis of the pin in such a manner that the inner surface is first biased into contact with the locking surface and then is biased into locking engagement with the locking surface as the window is moved from the closed to the open position.

The present invention is also directed to a wall box dimming system comprising:

dimmer control means for enabling an operator of the dimming system to enter information regarding n desired intensity levels for each of m groups of lights, m and n being integers greater than 1;

scene control means for enabling an operator of the dimmer to enter information concerning which respective one of the n intensity levels each of the m groups of lights should be operated at;

dimmer electronics for controlling the intensity of the lights in accordance with information entered into the dimmer control means and the scene control means, the dimmer electronics being located in a wall box housing; and a face plate assembly coupled to the wall box housing, the dimmer control means and the scene control means being accessible to an operator of the dimmer from an entry position located in front of the face plate assembly, the face plate assembly having an outer profile as viewed from the entry position which is larger than, but which fully encompasses, an outer profile of the wall box housing as viewed from the entry position; at least a portion of the dimmer control means and/or the scene control means being located at a position outside of the outer profile of the wall box housing.

The present invention is further directed to a switch assembly comprising:

a cradle having n openings formed in a front wall thereof, n being an integer greater than 1;

a circuit board housed in the cradle; and n switch means mounted on the circuit board, each of the switch means including an associated actuating member, each actuating member extending through a respective one of the openings in the front wall of the cradle.

The actuating members are preferably push buttons, each push button being associated with a respective opening in the front wall of the cradle. Each push button preferably has a planar base section and an elongated tongue section extending perpendicular thereto. The tongue section extends through its associated opening. The base section is received in a respective recess formed in the front wall of the cradle surrounding its associated opening. Each recess is larger than its associated base section such that each base section is fully housed in its associated recess.

The present invention is further directed towards a face plate with indicator lamp, comprising:

a face plate formed of a generally opaque material and having front and rear surfaces;

an annular recess formed in said face plate and extending from said rear surface to a position spaced from said front surface such that a relatively thin ring of material remains adjacent said front surface; and lamp means located adjacent the rear surface in the area of the annular recess; thickness and opacity of the thin ring of material and the intensity of light generated by the lamp means being such that a circular band of light can be seen from a position in front of the front surface of the face plate when the lamp means is on.

BRIEF DESCRIPTION OF THE DRAWINGS

For the purpose of illustrating the invention, there is shown in the drawing several forms which are presently preferred, it being understood, however, that the invention is not limited to the precise arrangement and instrumentality shown.

FIG. 1*a* illustrates a knob for controlling the light intensity of a hidden night lamp of FIG. 1.

FIG. 1*b* illustrates an alternate embodiment wherein a screw adjustment is substituted for the knob of FIG. 1*a*.

DESCRIPTION OF THE PREFERRED EMBODIMENT

Figure 1:
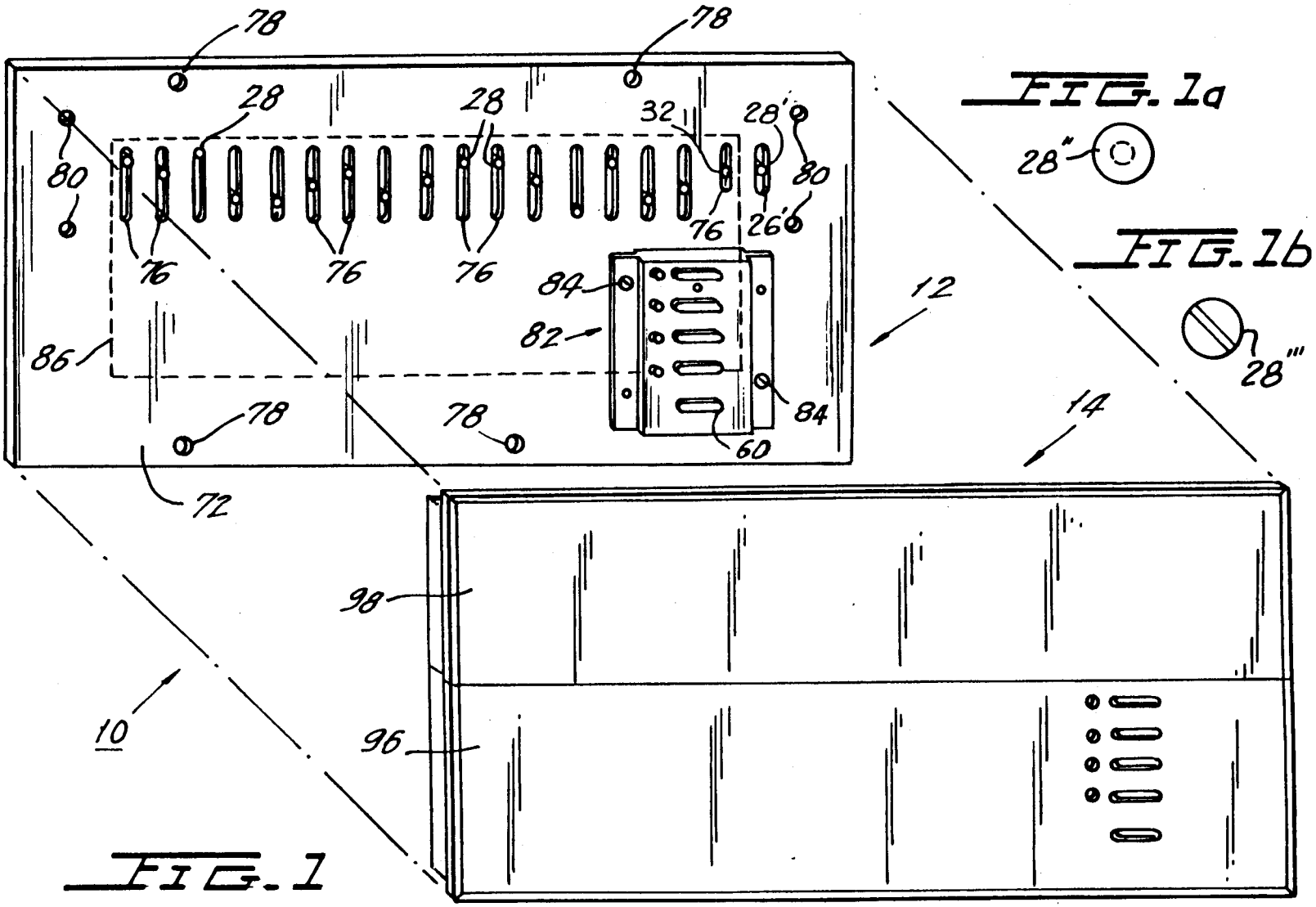
FIG. 1 is an exploded perspective view of the dimming system assembly of the present invention.
Figure 3:
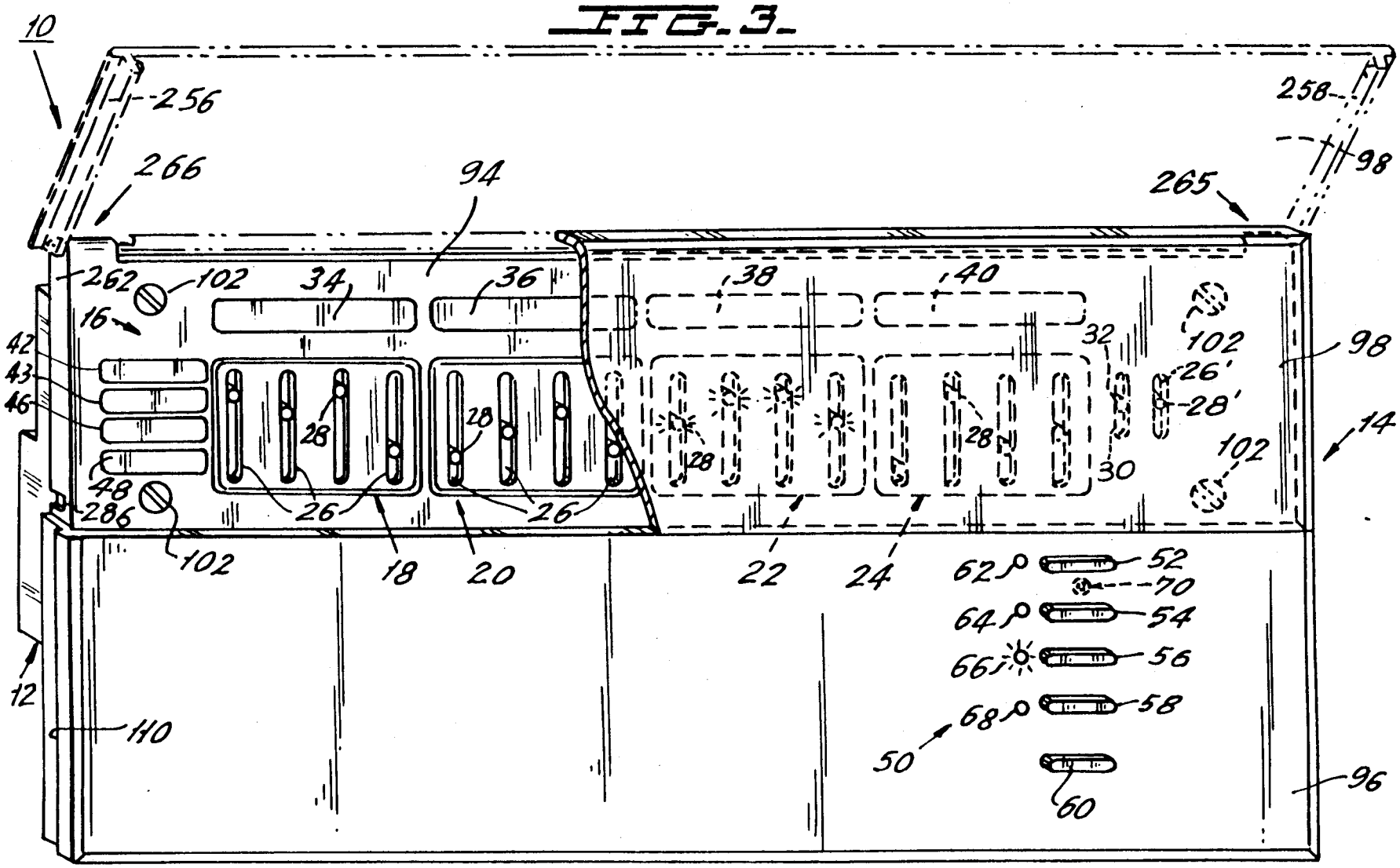
FIG. 3 is a partial perspective view of the front of the dimming system assembly of FIG. 1.

Referring now to the drawings wherein like numerals indicate like elements, there is shown in FIGS. 1 and 3 a wall box dimming system assembly constructed in accordance with the principles of the present invention and designated generally as 10. Wall box dimming system assembly 10 includes an electronics module 12 and a face plate assembly 14.

The electronics module 12 contains the electrical components required to control a plurality of lights in accordance with dimmer settings and scene information entered by the operator of dimmer assembly 10 at the face plate assembly 14. Since the present invention is directed primarily towards the mechanical structure of various elements of the dimmer assembly, and since control electronics for carrying out the required dimming functions are generally known as exemplified by U.S. Pat. No. 4,575,660, the electronics will not be described herein. In order to understand the importance of various structural components, however, it is useful to provide a brief description of the control functions carried out by wall box dimming system assembly 10.

In the embodiment illustrated, wall box dimming system assembly 10 will control the operation of four groups of lights in accordance with any of four preset scenes. By way of example, it might be desirable in a restaurant setting to have the lighting in a maitre'd area at a first level, the lighting at the center of a restaurant at a second level, the lighting along the periphery of the restaurant at a third level, and the lighting in the bar area at a fourth level. During different times of the day, it will also be desirable to change both the absolute intensity of the lights and the relative intensity of various groups of lights.

To this end, face plate assembly 14 includes a dimmer control panel 16 (FIG. 3) which permits the operator of dimming system assembly 10 to enter the desired parameters. Dimmer control panel 16 is located in the upper half of face plate assembly 14 and is covered by a pivotable window 98 which is preferably made of a translucent smoky plastic material. Window 98 pivots between the closed position illustrated in solid lines and the open position illustrated in phantom in FIG. 3.

The dimmer control panel 16 includes four scene control groups 18, 20, 22 and 24, each of which controls the light intensity of a different scene. Each scene control group 18–24 is associated with four slide potentiometers which form part of the control electronics in electronics module 12 and which control the intensity of four separate groups of lights as is well known in the art. The slide control arm of each potentiometer extends through a respective slot 26 in the face plate assembly 14 to enable the operator of wall box dimming system assembly 10 to slide the control arms 28 of the potentiometers to the desired intensity level.

An LED is located at the tip of each slide control arm 28. Only the LEDs of the particular control group 18, 20, 22 or 24 which is presently controlling the intensity of the lights will be lit. In FIG. 3, the LEDs of the slide control arms 28 of scene control group 22 are lit indicating that that third control group is presently controlling the intensity level of the lights. When window 98 is in the closed position, the lit LEDs of scene control group 22 will be visible through the smoky plastic of window 98, thereby informing the operator of dimming system assembly 10 of the relative intensity levels of the dimmer control group presently controlling the lights. The remaining structure of dimmer control panel 16 is not visible through the window 98, thereby providing a highly pleasing aesthetic appearance.

In addition to control groups 18–24, dimmer control panel 16 includes a slot 30 through which the slide arm 32 of a fade rate potentiometer extends. The fade rate potentiometer forms part of the electronics in electronics module 12 and controls the rate at which light intensity levels change from one scene to another (control will be transferred from one scene to another in response to the actuation of scene control buttons 52–58 by the operator dimming system assembly 10 as described below). The operator of dimming system assembly 10 controls the fade rate by adjusting the position of slide arm 32 when window 98 is in the open position.

Recessed areas 34, 36, 38 and 40 are formed above scene control groups 18, 20, 22 and 24, respectively and are adapted to receive labels or similar indicia which provide the user with information concerning each scene control group 18–24. By way of example, a label entitled "morning" may be placed in recessed area 34 to indicate that scene control group 18 is a morning scene, a label entitled "afternoon" may be placed in recess 36 to indicate that scene control group 20 is an afternoon scene, etc.

Four additional recessed areas 42–48 are provided at the left-hand edge of dimmer control panel 16 and are adapted to receive labels or similar indicia indicating the particular group of lights controlled by each of the potentiometers of the scene control groups. By way of example, if the left-most potentiometer of each scene control group controls the lighting at the maitre'd area, a label entitled "maitre'd" will be placed in recess 42; if the second potentiometer of each control group controls the lighting at the center of the dining area, a label entitled "chandelier" will be put in recess 44, etc.

The lower right-hand section of face plate assembly 14 includes a scene control panel 50 including four-scene push-button switches 52, 54, 56 and 58 and Off push-button switch 60. Each of the scene control push-button switches 52, 54, 56 and 58 is associated with a respective scene control group 18, 20, 22 and 24. Whenever one of the scene push-button switches 52–58 is depressed, the lights being controlled will switch from the light intensities of the prior scene to the light intensities of the newly selected scene at the rate determined by the position of the fade rate slide control arm 32. Indicator control lamps 62, 64, 66 and 68 are located adjacent scene push-button switches 52, 54, 56 and 58, respectively, and indicate which scene is presently active. In FIG. 3, the indicator lamp 66 associated with the third scene, which is presently active, is on and the remaining lamps are off.

Off push-button switch 60 is located below switches 52–58 and is the main Off power control switch for the dimming system assembly 10. A lighted indicator 70 (the structure of which is described below) is preferably provided between push-buttons 52, 54 to indicate whether the dimming system assembly 10 (and therefore the lights being controlled by the dimming system assembly) are on or off. Lighted indicator 70 takes a different form than, and is located in a different relative position than, indicator lamps 62–68 to be easily distinguishable therefrom.

For ease of assembly, the electronics module 12 of dimming system assembly 10 should fit within a standard four-gang wall box. While such wall boxes are relatively wide, their height is relatively small. For aesthetic reasons, it is desirable for the height of the face plate assembly 14 to be greater than the height of a standard four-gang wall box. The face plate assembly 14 should also be as thin as possible so as to project from the wall in which the wall box is located to as small a degree as possible.

When window 98 is in the closed position, face plate assembly 14 should have the appearance, to the degree possible, of a unitary structure. When the window 98 is raised to the open position, it should be latched in that position so that the operator of dimming system assembly 10 can adjust the lighting levels of the various scene control groups 18–24 without having to manually hold the window 98 in the upper position. The mechanical structure of the present invention, which will now be described in detail, enables all of the foregoing results.

Referring to FIG. 1, the electronics module 12 includes an aluminum face plate or yoke 72 and a back cover 74 coupled thereto. The back cover 74 houses the electronics required to dim the lights in accordance with the information entered into the dimmer control panel 16 and scene control panel 50. The yoke 72 operates as both a mounting structure for these circuits and a heat sink for the dimming elements The control arms 28 of the dimming potentiometers and the control arm 32 of the fade potentiometer extend through respective slots 76 in yoke 72. Through holes 78 are formed along the top and bottom edges of yoke 72 to permit the yoke to be screwed into the four-gang wall box in the standard manner. Four threaded openings 80 are formed in the upper left- and right-hand sides of yoke 72 and are used to affix face plate assembly 14 to yoke 72 as described below.

Once the dimming levels of each scene and the fade rate has been selected, they are normally maintained at the preset level for relatively long periods of time. For this reason, the control arms 28 and 32 of the dimmer control panel 16 are normally located behind the closed window 98 so as to limit access thereto.

The particular scene which is active, on the other hand changes several times a day. For this and aesthetic reasons, the scene push button switches 52–58 and the Off push button switch 60 are easily accessible and are preferably located below window 98 on switch plate 96 as shown in FIG. 3.

In order to achieve the desired aesthetic effect, at least the push button switch 60 is located at a position outside of the outer profile 86 of back cover 74 (FIG. 1) and also outside the outer profile of a standard four gang electrical wall box as viewed from an entry position (where the operator of dimming system assembly 10 enters dimming and scene change information into the system) located in front of face plate assembly 14. To achieve this result, the push button switches 52–60 and the indicator lights 62–68 are formed as part of an integral switch assembly 82 mounted on the lower right-hand corner of yoke 72 by a pair of screws 84. Switch assembly 82 must be small in size and sufficiently rugged to withstand the forces applied to the push buttons 52–60 during the normal use of dimmer assembly 10. It also must be thin in order to minimize the required depth of face plate assembly 14. The preferred structure of switch assembly 82 for achieving this result is described in detail with reference to FIGS. 7–12 below. While switch assembly 82 must extend below the bottom edge 86 of back cover 64, it must also be electrically connected to the control circuitry in back cover 74. To this end, a plurality of leads 222 (FIG. 7) extend out the rear of switch assembly 82, through an opening (not shown) in yoke 72 and into the back cover 74 of electronics module 12.

Figure 2:
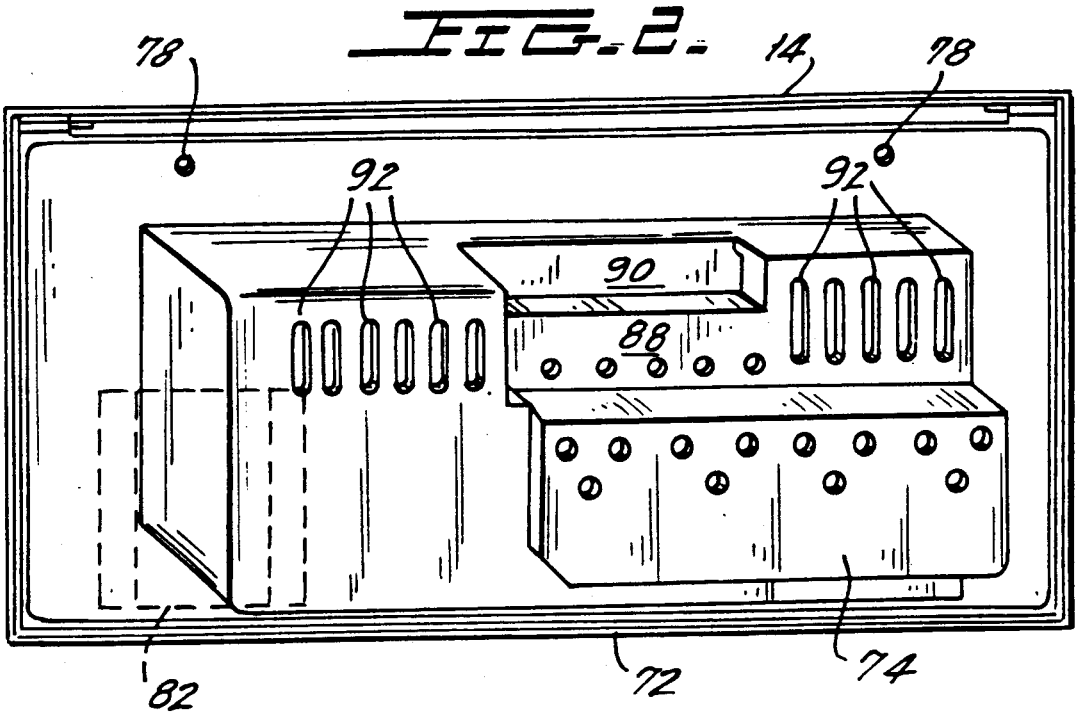
FIG. 2 is a perspective view of the rear of the dimming system assembly of FIG. 1.

During installation of the wall box dimming system assembly 10, leads (not shown) extending from the back cover 74 are connected to wires located in a standard four-gang wall box and leading to the lights being controlled. Once the leads of the dimmer assembly have been appropriately wired, the back cover 74 is fitted into the four-gang wall box. The overall volume of the back cover 74 must be less than the available volume in the wall box in order to permit accommodation of the connecting wires and wire connectors used to couple the wires together. For this reason, the depth of back cover 74 should be as shallow as possible. Unfortunately, certain of the electrical components located in rear cover 74 are relatively large and make it necessary for the depth of at least portions of the cover 74 to be relatively great. In order to accommodate these conflicting needs, rear cover 74 preferably has an irregular shape as illustrated in FIG. 2. The particular shape is dictated by the space needs of the electronic components in cover 74. The depth of the rear cover is minimized wherever possible. In the embodiment illustrated in FIG. 2, recessed space 88 is provided and will help to accommodate the electrical wiring and associated wire connectors. A plurality of openings 92 are formed along the rear of back cover 74 to permit the escape of heat created by the dimming components in cover 74.

Figure 4:
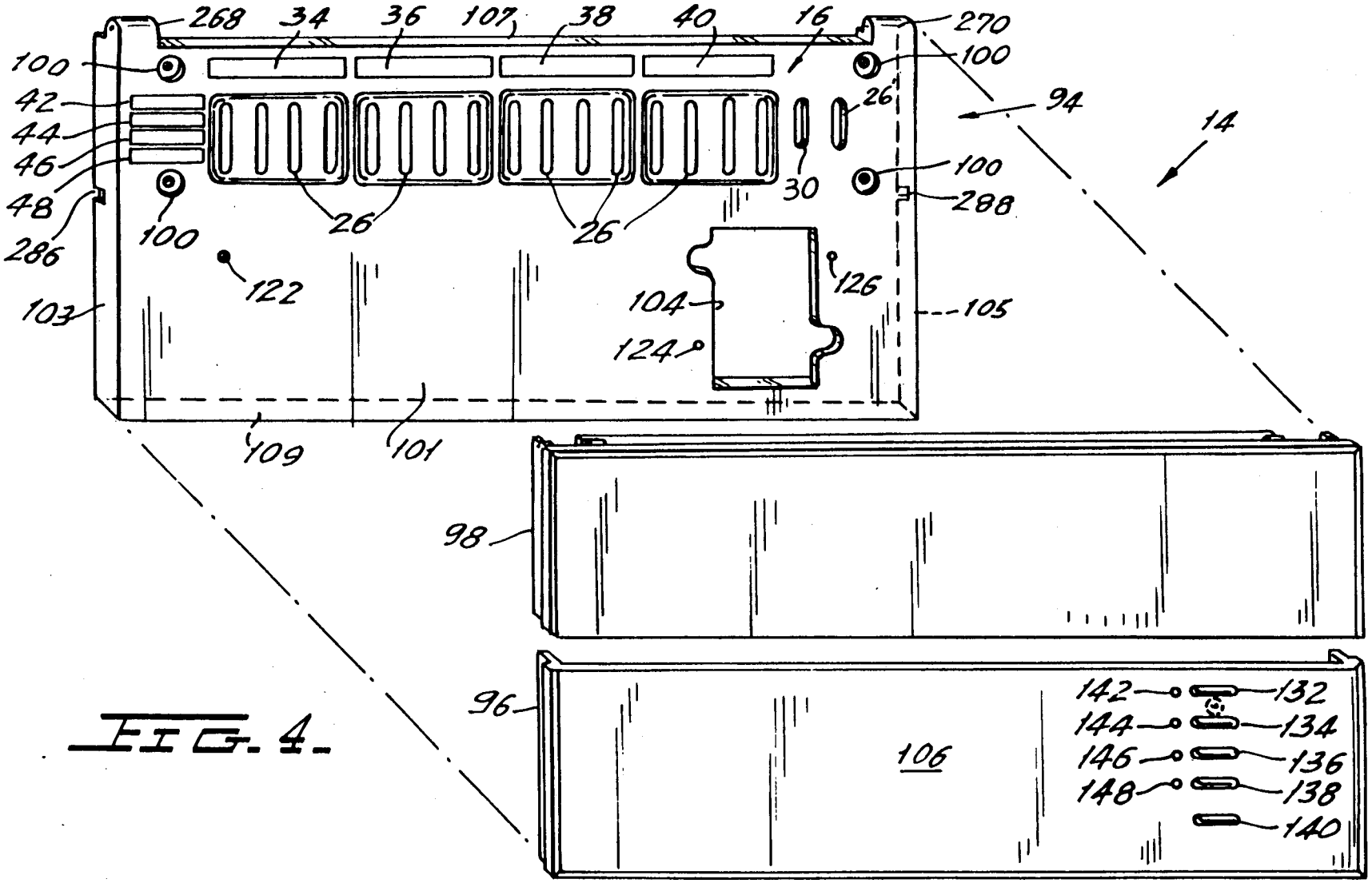
FIG. 4 is an exploded perspective view of the face plate assembly forming part of the dimming system assembly of FIG. 1.

An exploded view of the face plate assembly 14 is illustrated in FIG. 4. As shown therein, face plate assembly 14 includes a support plate 94, a switch plate 96 and window 98. Support plate 94 is preferably formed of a molded plastic material and has a dark color (e.g. black) so that it is difficult to see when window 98 is in the closed position. The slots 26, 30 and recessed areas 34–48 of the dimmer control panel 16 described above with reference to FIG. 3 are formed in support plate 94 during the molding process. Recessed through-holes 100 are also provided and receive screws 102 (FIG. 3) which extend into threaded openings 80 in yoke 72 (FIG. 1) to secure support plate 94 (and with it switch plate 96 and window 98) to the electronics module 12. The through-holes 100 are recessed so that the top of the screws can be flush with the front planar surface of support plate 94 so as to avoid the addition of any additional depth to face plate assembly 14. A switch assembly opening 104 is formed in the lower right-hand corner of support plate 94 at a location corresponding to the location of switch assembly 82 and permits the push-buttons 52–60 and indicator lamps 62–68 of switch assembly 82 to extend through support plate 94.

The slots 26 and opening 104 are formed in the front wall 101 of the support plate 94. The dimensions of front wall 101 are a slightly greater than those of yoke 72 so that yoke 72 will be fully hidden behind front wall 101. Side walls 103, 105 and top and bottom walls 107, 109 are coupled to the outer edges of front wall 101 and extend orthogonally thereto. The depth of walls 103, 105, 107 and 109 are selected to fully encompass both yoke 72 and switch assembly 82 and yet minimize the degree to which the face plate assembly 14 projects from the wall on which it is mounted. A pair of coupling sections 268, 270 are formed on the left and right hand upper edges of support plate 94 and form part of the hinges which couple support plate 94 to window 98 as will be described in detail below.

Figure 6:
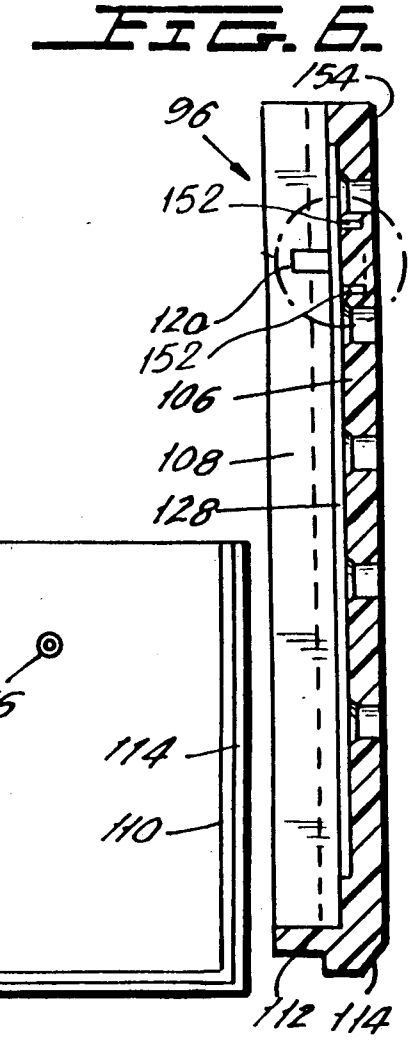
FIG. 6 is a cross sectional view of the switch plate taken along lines 6—6 of FIG. 5.
Figure 5:
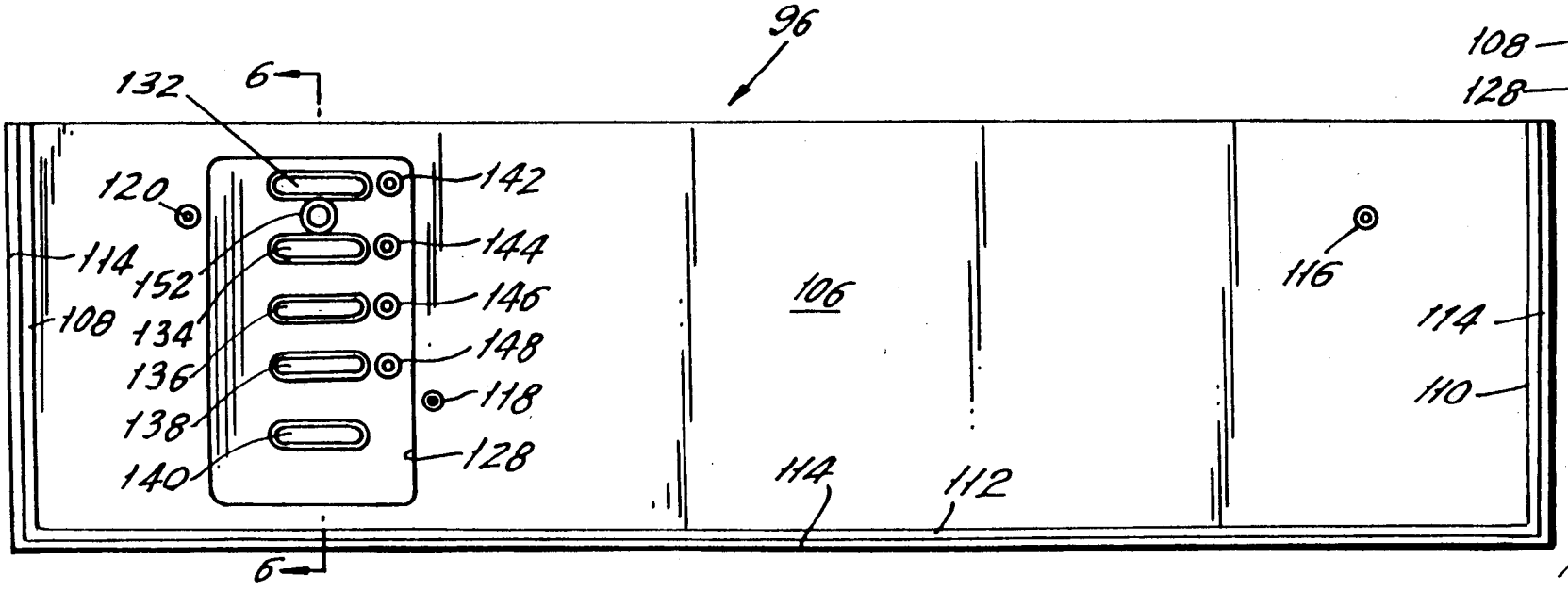
FIG. 5 is a rear plan view of the switch plate forming part of the face plate assembly of FIG. 4.

As best shown in FIGS. 5 and 6, the switch plate 96 includes a major planar front wall 106, side walls 108, 110 and bottom wall 112. The side and bottom walls 108–112 are of sufficient depth to cover the side walls 103, 105 and bottom wall 109 of support plate 94 when the dimming system assembly 10 is fully assembled so that the support plate 94 cannot be seen from the side of face plate assembly 14 when wall box dimming system assembly 10 is installed in a wall box as best shown in FIG. 3. A chamferred skirt 114 is formed along the walls 108–112 to provide a pleasing aesthetic effect. The switch plate is preferably made of an opaque, i.e. light absorbing or reflecting, plastic material. Its color is preferably different (e.g., white) than that of window 98.

Three alignment pins 116, 118 and 120 are formed on the inside surface of front wall 106 and extend perpendicular thereto. The height of these pins is less than the depth of walls 108–112 but is sufficient to extend through holes 122, 124 and 126 (FIG. 4), respectively in support plate 94. During assembly, switch plate 96 is placed over the bottom half of support plate 94 with pins 116–20 passing through holes 122–26 and the switch plate 96 is glued or otherwise affixed to the support plate 94.

A shallow recess 128 (FIG. 5) is formed in the rear surface of front wall 106 and is adapted to receive the front face 130 (FIG. 7) of switch assembly 82. Five chamferred oval openings 132, 134, 136, 138 and 140 are formed in front wall 106 to receive respective push button switches 52, 54, 56, 58 and 60. Circular openings 142, 144, 146 and 148 are formed adjacent openings 132–138 to receive respective indicator lights 62, 64, 66 and 68.

Figure 6A:
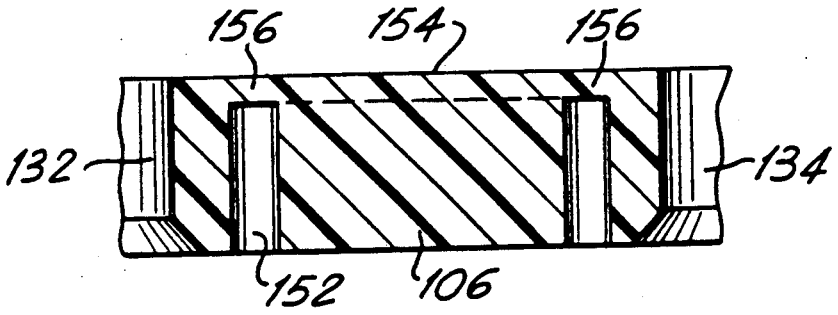
FIG. 6*a* illustrates a first embodiment of a lamp recess associated with the circled portion of FIG. 6.

Referring to FIG. 6*a*, an annular recess 152 is formed in the front wall 106 in the area between openings 132 and 134. Recess 152 extends almost to the front surface 154 of wall 106 leaving a thin wall 156 adjacent surface 154. The wall 156 is sufficiently thin (preferably about 0.010 inches) to be translucent and a light source (not shown in FIG. 6) located adjacent annular recess 152 will cause a small ring of light to pass through the thin wall 156 providing the lighted indicator 70 of FIG. 3. The foregoing structure of lighted indicator 70 is highly advantageous both in its simplicity and the pleasingly aesthetic quality of the indicator. When the indicator is off, the portion of switch plate 96 in the area of indicator 70 appears to be a mere continium of the remainder of the switch plate. When the indicator is on, a soft annular ring appears in the area between switches 132 and 134 providing a pleasant, but easily visible and distinguishable, indication that the dimming system is off.

Figure 6B:
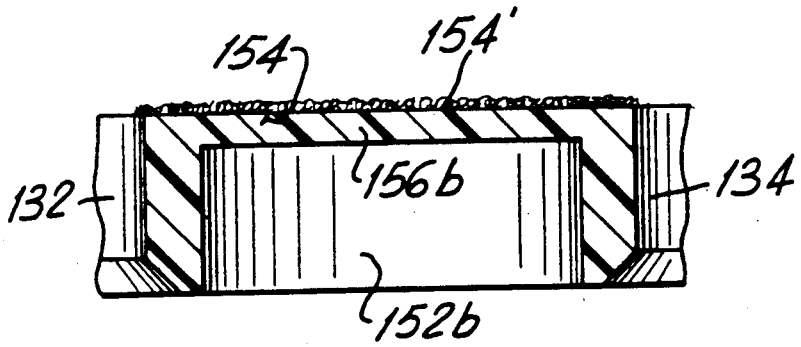
FIG. 6*b* illustrates a second embodiment of a lamp recess associated with the circled portion of FIG. 6.

In the embodiment of FIG. 6*b*, the function of the annular recess 152 is provided by a cylindrical recess 152*b*. But the shape of the recess 152*b* may also be hexagonal, square, etc. Further, the exposed outer surface 154 directly above the recess 152*b* contains a roughened/textured region 154' which is effective for diffusing the light from the indicator 70 to provide wider angles of viewing of the light emitted from indicator 70.

Figure 6C:
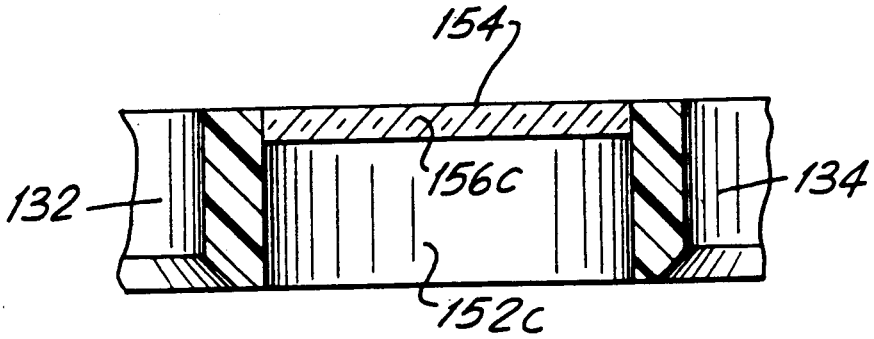
FIG. 6*c* illustrates a third embodiment of a lamp recess associated with the circled portion of FIG. 6.
Figure 6D:
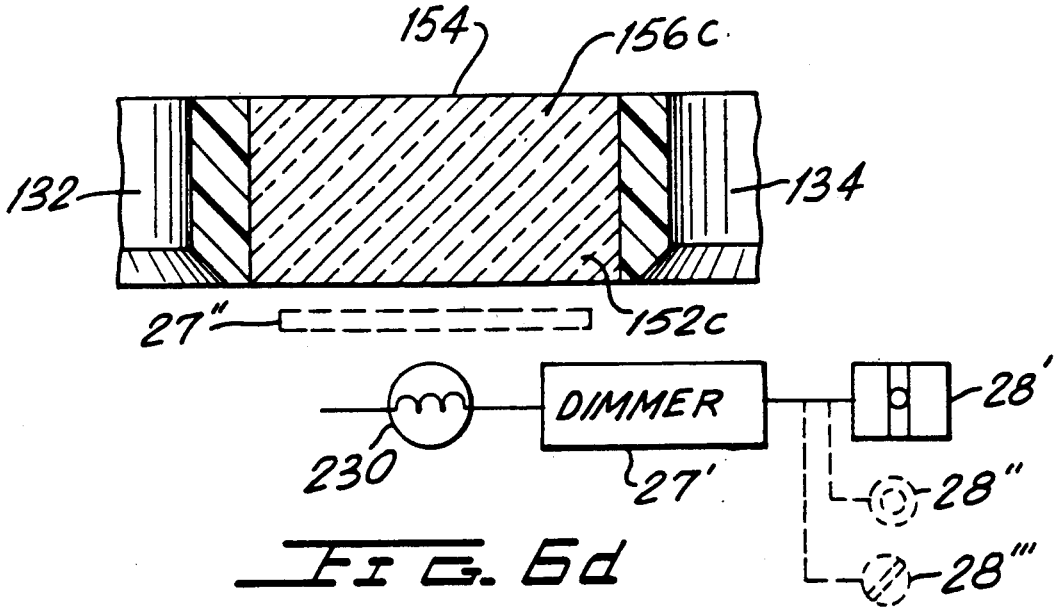
FIG. 6*d* illustrates a fourth embodiment of a lamp recess associated with the circled portion of FIG. 6, further illustrating a lamp and dimmer arrangement.

In FIG. 6*c*, the recess 152*c* is formed by the removal of the entire volume of the wall 106 above the lamp indicator 70, forming a through-going recess 152*c*, and the partial backfilling thereof with an optically less-dense material such as, for example, a translucent plastic, to form a recess cover 156*c*. Preferably, the material of the recess cover 156*c* is of the type which diffuses light. In FIG. 6*d*, the entirety of the through-going recess 152*c* is backfilled with the optically less-dense material of which the recess cover 156*c*, in FIG. 6*c*, is formed.

Figure 6E:
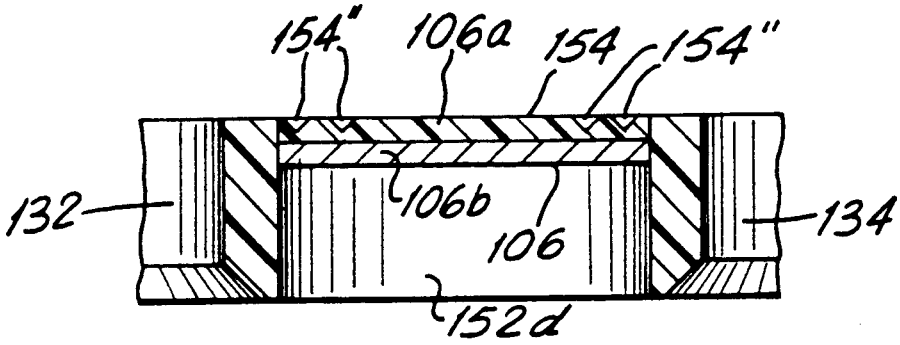
FIG. 6*e* illustrates a fifth embodiment of a lamp recess associated with the circled portion of FIG. 6 and taken along line 6*e* of FIG. 6*f*.
Figure 6F:
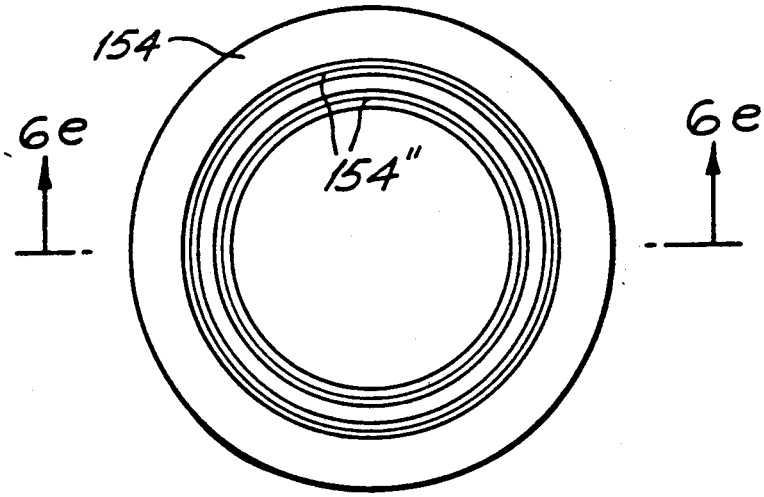
FIG. 6*f* is a top view of the fifth embodiment of FIG. 6*e*.

In accordance with a further embodiment (FIGS. 6*e* and 6*f*), one or more V-shaped annular grooves 154" are etched into the outer surface 154 above a recess 152*d*. The V-shaped grooves 154" serve to diffuse and bend light passing through the surface 154 at sharper angles to increase the viewability of the light emitted from lamp indicator 70. Further, as seen in FIG. 6*e*, the thin region of material enclosing the recess 152*d* may be comprised of a first section 106*a* which overlies a second section 106*b*. The second section 106*b* is comprised of translucent plastic while the first section is of the same material as, and is integral with, the wall 106. As is obvious from the foregoing, light emitted from a light source located behind the recess 152 passes through the recesses to the front surface of the wall 106 and produces the lighted indicator 70 of FIG. 3, in a shape which is largely determined by the shape of the recess 152.

Figure 8:
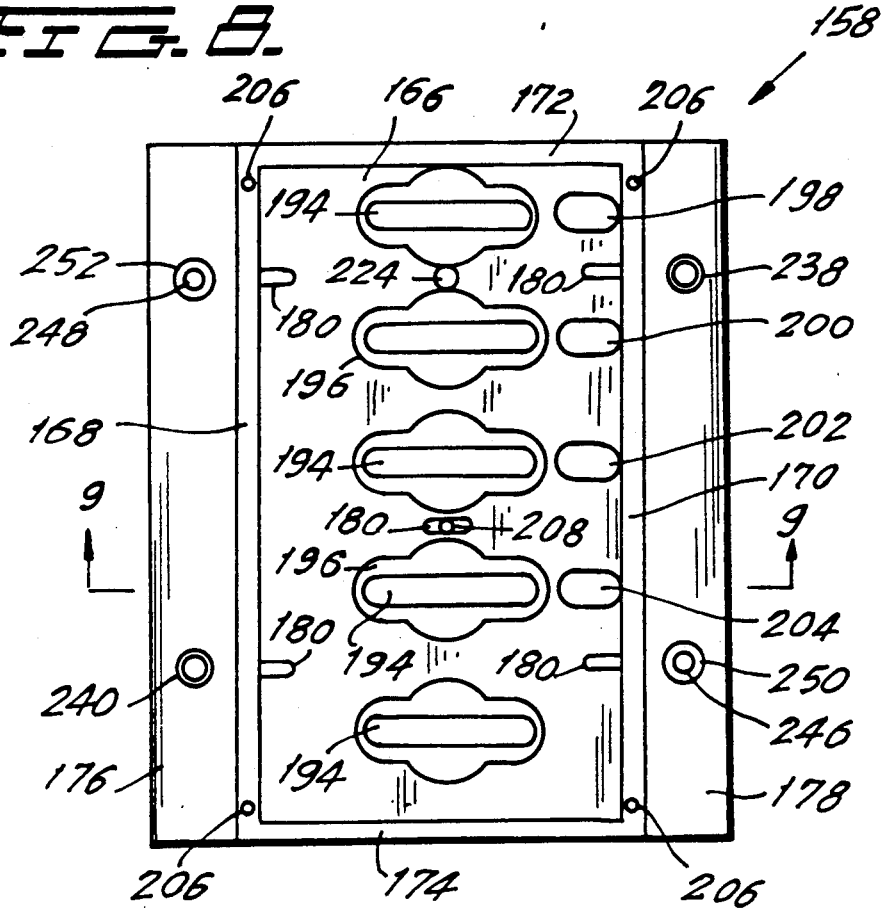
FIG. 8 is a rear plan view of a cradle forming part of the switch assembly of FIG. 7.
Figure 9:
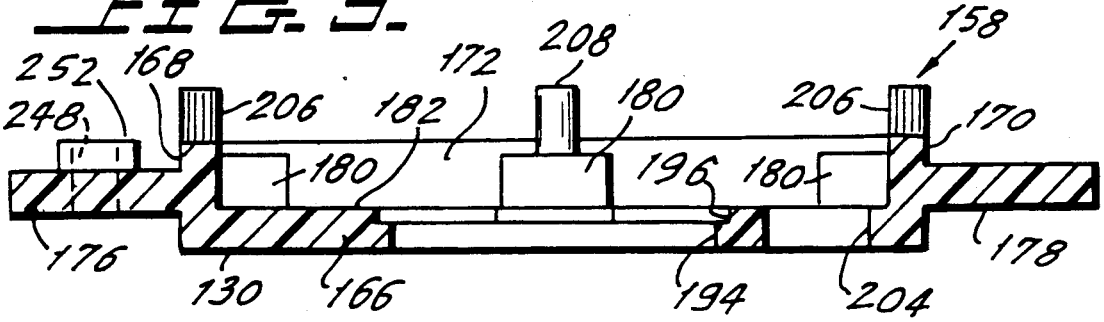
FIG. 9 is a sectional view of the cradle taken along lines 9—9 of FIG. 8.
Figure 10:
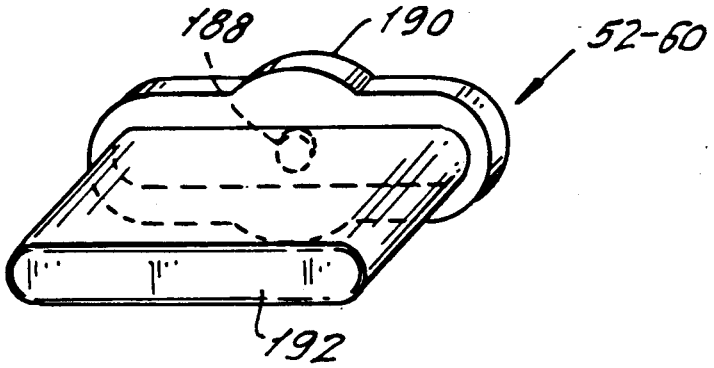
FIG. 10 is a perspective view of a push button switch forming part of the switch assembly of FIG. 7.
Figure 11:
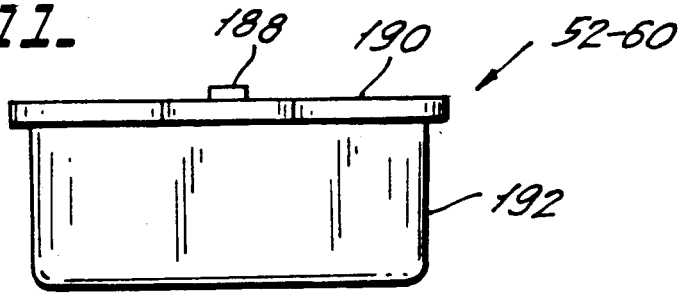
FIG. 11 is a top view of the push button of FIG. 10.
Figure 7:
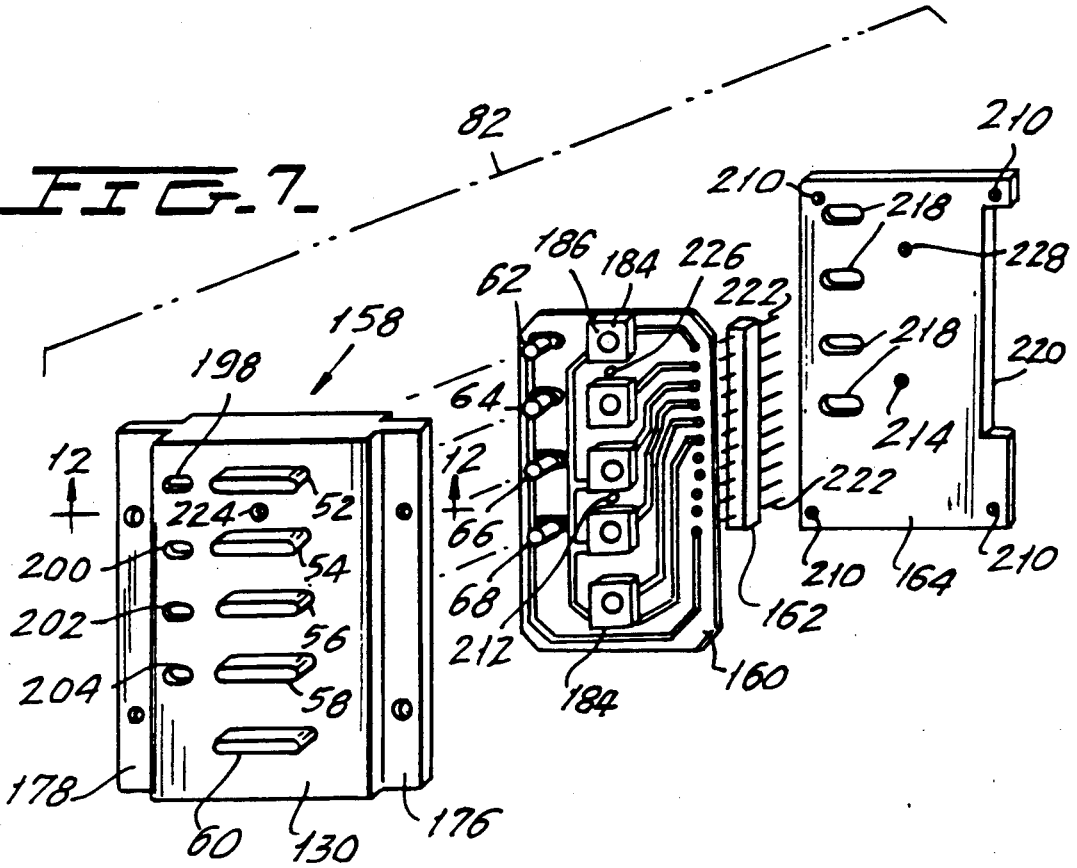
FIG. 7 is an exploded perspective view of the switch assembly of the present invention.

As shown in FIGS. 7-11 and 13, switch assembly 82 includes a cradle 158, a circuit board 160, a pin connector 162 and a cradle cover 164. The cradle 158 houses both the push buttons 52-60 and the circuit board 160. As best shown in FIGS. 8 and 9, the cradle 158 includes a front wall 166, a pair of side walls 168, 170, top and bottom walls 172, 174 and side flanges 176, 178. Support ledges 180 are provided at spaced locations in cradle 158 to support the circuit board 160 along a plane spaced from but parallel to the rear surface 182 of front wall 166 (see FIG. 12). The ledges 180 are of a sufficient height to cause the front face of micro switches 184 (FIG. 7) to be located just above rear surface 182 so that the actuating pad 186 of each microswitch 184 is in contact with a dimple 188 (FIGS. 10 and 11) formed on the rear of the push buttons 52-60. As shown in FIGS. 10 and 11, the push button 52-60 has a generally oval shaped base 190 having a elongated tongue 192 extending from one side thereof. The small cylindrical dimple 188 extends from the other side thereof. Each of the push buttons 52-60 extends through a respective opening 194 in front wall 166 of cradle 158 and projects out the front face 130 thereof as best illustrated in FIG. 7. A recess 196 (FIG. 9) surrounds each opening 194 and is shaped to closely accommodate the base 190 of the associated push button 52-56. The depth of the recess 196 is preferably equal to the depth of the base 190 so as to minimize the thickness of switch assembly 82.

Referring to FIG. 8, a plurality of oval openings 198, 200, 202 and 204 are provided in front wall 166 to accommodate the generally oval bases of indicator lamps 62, 64, 66 and 68, respectively. The cylindrical tip of lamps 62-68 are sufficiently long to extend through front wall 166, into the openings 142, 144, 146 and 148, respectively, in switch plate 96 and to a position flush with the front face 154 of switch plate 96 when face plate assembly 14 is fully assembled.

Peripheral bosses 206 are provided along the side walls 168, 170 of cradle 158 and a central boss 208 is provided at the top of the central ledge 180. The bosses 206 extend through corresponding openings 210 (FIG. 7) in the four corners of cradle cover 164. Central boss 208 extends through an opening 212 in circuit board 160 and an opening 214 in cradle cover 164. The height of bosses 206, 208 is greater than the thickness of cradle cover 64 so that when the cradle cover 64 is placed on the back surface 216 of walls 168-174, the bosses 206, 208 will extend through and slightly behind the cradle cover 164. Bosses 206, 208 are then melted by the application of heat so that they flow into and fuse with the openings 210, 214 thereby forming a unitary package with cradle 158.

Referring to FIG. 7, a plurality of oval openings 218 are formed in the cradle cover 164 at locations corresponding to the rear of indicator lights 6214 64, respectively. The terminals of these lights are soldered at the rear of circuit board 160 (not shown) with the result that some solder extends above the rear surface of circuit board 160. The openings 218 accommodate this raised solder.

As shown in FIG. 7, a notch 220 is formed on the right side of cradle cover 164 to accommodate the pin connector 162 which is soldered to the rear of circuit board 160. The short end of the individual pins 222 of the pin connector 162 extend into respective holes (unnumbered) along the right side of circuit board 160 to provide electrical connections to the various components on circuit board 60. It should be noted that the four holes which do not have circuit board leads connected thereto on the front surface of circuit board 160 have leads on the back surface of the circuit board connecting to the rear terminals of the four indicator lamps 62-68, respectively. The long ends of pins 222 extend out the rear of switch assembly 82 (in the assembled state) and extend through an opening (not shown) in yoke 72 into the electronics module 12 where they are connected to appropriate control circuits.

Figure 12:
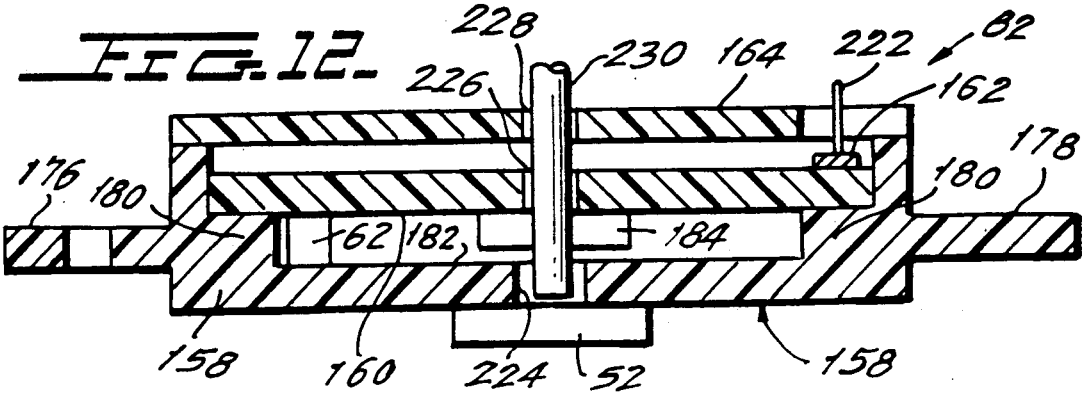
FIG. 12 is a cross sectional view of the switch assembly in the assembled state taken along lines 12—12 of FIG. 7.

As best shown in FIG. 12, a series of openings 224, 226 and 228 are formed in the cradle 158, circuit board 160 and cradle cover 164, respectively. These openings accommodate a long, narrow lamp 230 whose base is located in the electronics module 12 and which extends through an opening (not shown) in the yoke 72. The lamp 230 is sufficiently long to extend to a position just behind the front face 130 of switch assembly 82. Lamp 230 is located directly behind annular opening 152 (FIGS. 6) in switch plate 96 when the dimming system assembly 10 is in the assembled state. When the dimming system is off, the circuitry in electronics module 12 turns on lamp 230 causing an illuminated ring to appear in the area of recess 152.

In connection with the lamp 230, the present invention also provides a slot 26' (FIGS. 1, 3 and 4) for a dimmer control arm 28' which is coupled to a continuously dimmable dimmer 27' (FIG. 6*d*). The dimmer 27' enables controlling the light intensity of the lamp 230. While the embodiment of FIG. 1 illustrates the control arm 28' as a linearly movable lever, a rotary knob 28'', as in FIG. 1*a* (also shown in dashed lines in FIG. 6*d*), or a screwdriver adjustable member 28''', as in FIG. 1*b* (also shown in dashed lines in FIG. 6*d*) may be used for the same purpose. Moreover, while the dimmer control arm 28' is depicted in a location where it is accessible at the face plate, the same may be hidden, e.g. under the face plate, or covered by a hinged door (not shown), or the like.

Alternatively, the intensity of the light striking the translucent material filling the recess 152*c* may be controlled by means of the variable density filter 27'' (FIG. 6*d*) or by a set of different filters.

Figure 13:
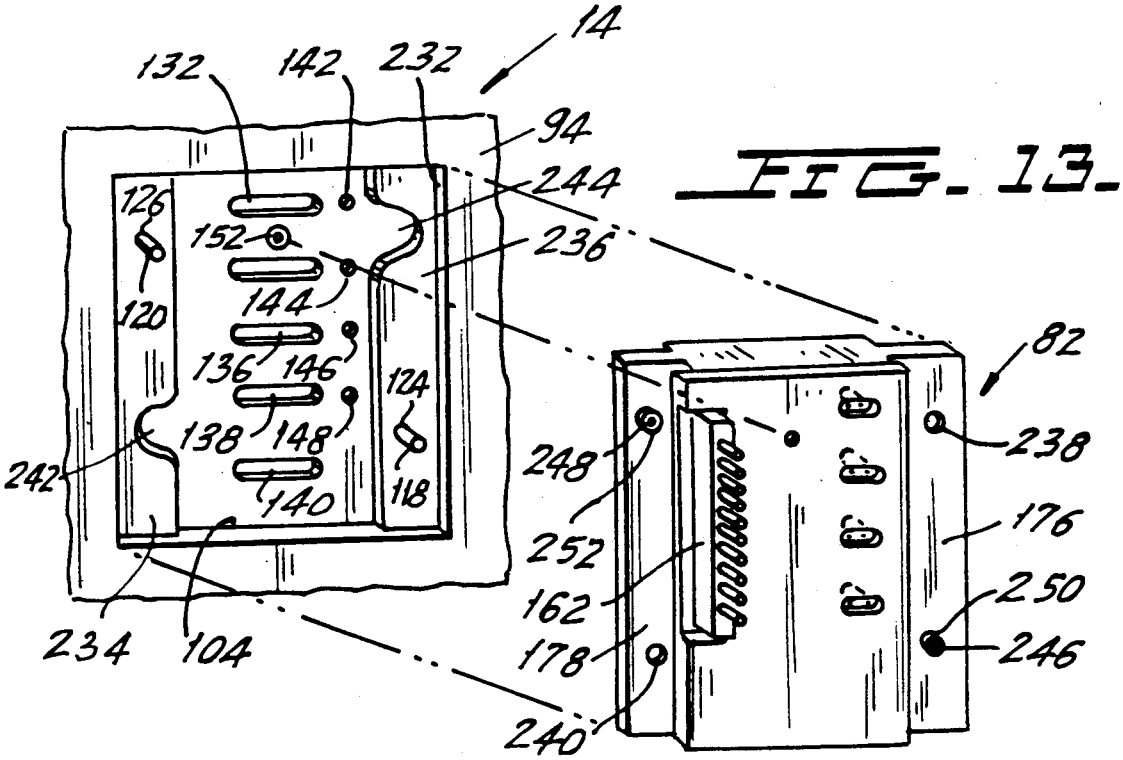
FIG. 13 is an exploded detail view showing the manner in which the switch assembly fits into the face plate assembly.

The manner in which switch assembly 82 is received in face plate assembly 14 is illustrated in FIG. 13. As shown therein, a recess 232 formed in support plate 94 receives the switch assembly 82. Ledges 234, 236 are formed in the left and right hand sides of recess 232 to receive side flanges 178, 176, respectively.

As shown in FIG. 1, switch assembly 82 is connected to yoke 72 by a pair of screws 84. The screws 84 extend through openings 238, 240 in ledges 176, 178, respectively. Cut out sections 242, 244 are formed in ledges 234, 236, respectively, to receive the heads of these screws. Through holes 246, 248 are also formed in ledges 176 and 178 and receive alignment pins 118, 120, respectively. Collars 250, 252 are formed around holes 246, 248 to extend the effective length of these holes and increase their interaction with pins 118, 120.

Figure 14:
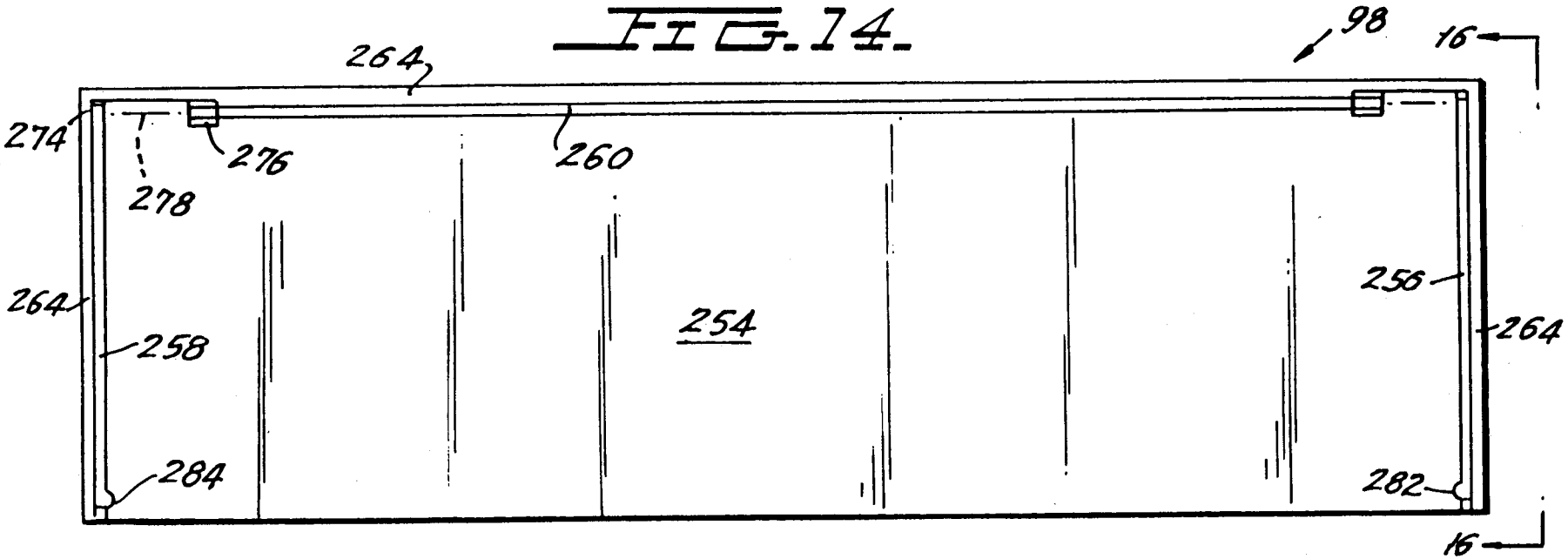
FIG. 14 is a rear plan view of a window forming part of the face plate assembly.
Figure 15:
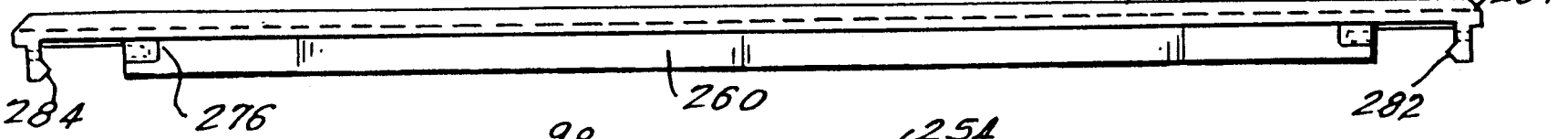
FIG. 15 is a top view of the window of FIG. 14.
Figure 16:
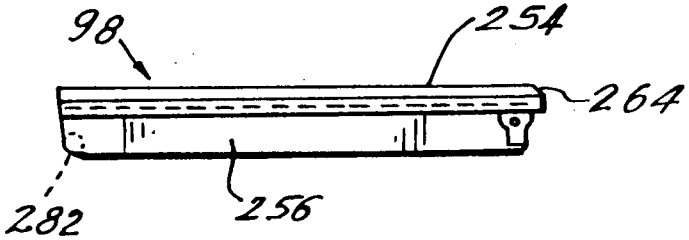
FIG. 16 is a right side view of the window taken along lines 16—16 of FIG. 14.

The structure of window 98 is illustrated in FIGS. 14-16. As shown therein, window 98 includes a planar front wall 254, a pair of side walls 256, 258 and a top wall 260. Side walls 256, 258 and top wall 260 all extend orthogonally from front wall 254 and have a depth equal to the depth of the side walls 103, 105 and the top wall 107, respectively, of support plate 94 so that upper portion of support plate 94 will be fully enclosed by window 98 when window 98 is in the closed position. A chamferred edge 264 is located adjacent side walls and top wall 256–260 for aesthetic purposes. The chamferred edge 264 on window 98 and the chamferred edge 114 on switch plate 96 cooperate to form what appears to be a substantially continuous edge when window 98 is in the closed position as best seen in FIG. 1.

The lowermost corners of walls 256, 258, are formed with dimples 282, 284, respectively. Dimples 282, 284 cooperate with recesses 286, 288 (FIG. 4), respectively, formed on opposite walls 262 of support plate 94 to lock window 98 in the closed position. Due to the elasticity of side walls 256, 258, the dimples snap into and out of the recesses 286, 288 when the window 98 is snapped into and out of the closed position. As best shown in FIG. 16, the bottommost edges of side walls 256, 258 are formed in a slight angle to insure that the window 98 will not interfere with switch plate 96 when the window 98 is being moved into the closed position.

During normal use, window 98 is in the closed position illustrated in solid lines in FIG. 3. In this position, the top half of support plate 94 is covered by the window and is generally hidden from view. The slide control arms 26 will not be visible with the exception of the four slide control arms associated with the scene control group 18, 20, 22 or 24 which is presently in control. More particularly, the LEDs at the top end of these control arms 26 will be lit and will be visible through the window 98.

If the operator of dimming system assembly 10 wishes to adjust the settings of one or more scenes, he pivots window 98 into the open position illustrated in phantom in FIG. 3. When placed in the open position, window 98 should remain in that position until returned to the closed position by the operator in order that the operator is free to adjust the positions of slide control arms 26 without having to hold window 98 open. To this end, the present invention incorporates a pair of novel hinges 265, 266, the structure of which is illustrated in FIGS. 17–21, which couple window 98 to support plate 94. The structure of these hinges are identical except that they are mirror images of one another. For this reason, only the structure and operation of hinge 265 will now be described.

Hinge 265 comprises the profiled coupling section 270 formed in support plate 94, pin support areas 274, 276 formed in window 98, a coupling pin 278 and the inner surface 280 of window 98. Coupling pin 278 is preferably made of spring steel and is supported at opposite ends by openings (unnumbered) formed in pin support areas 274, 276 of window 98.

Pin 278 extends through axial opening 282 to pivotally connect window 98 to support plate 94. As window 98 moves from the closed (FIG. 18) to the open (FIG. 20) position, its inner surface 280 slides along cam surface 284 formed in coupling section 270. Due to the novel structure of hinge 265, inner surface 280 is biased toward pin 278 with a continually increasing force as window 98 moves counter clockwise along cam surface 284 from the closed position of FIG. 18 to the horizontal position of FIG. 19. In the horizontal position, inner surface 280 contacts the ridge 288 intersecting cam surfaces 284, 286. As the window 98 is rotated further in the counter clockwise direction, this axial force pulls surface 280 into engagement with locking surface 286. In this position (FIG. 20), inner surface 280 of window 98 abuts locking surface 286, the edge 290 of window 98 abuts surface 292 of support plate 94 and window 98 is maintained in the open position.

Figure 18:
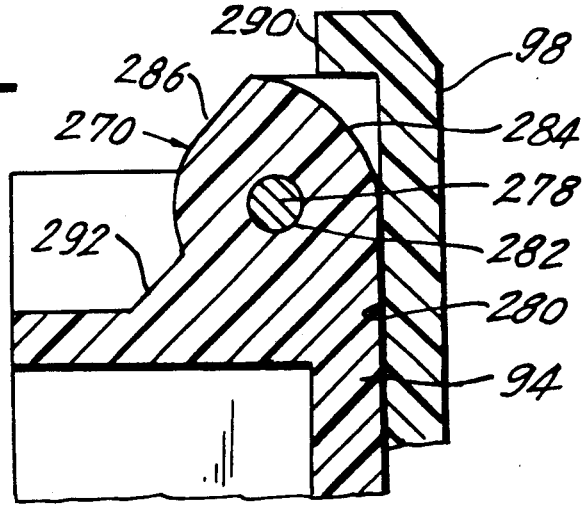
FIGS. 18 through 20 are cross sectional views taken along lines 18—18 of FIG. 17 showing the hinge of the present invention with the window in the closed, intermediate and open positions.
Figure 19:
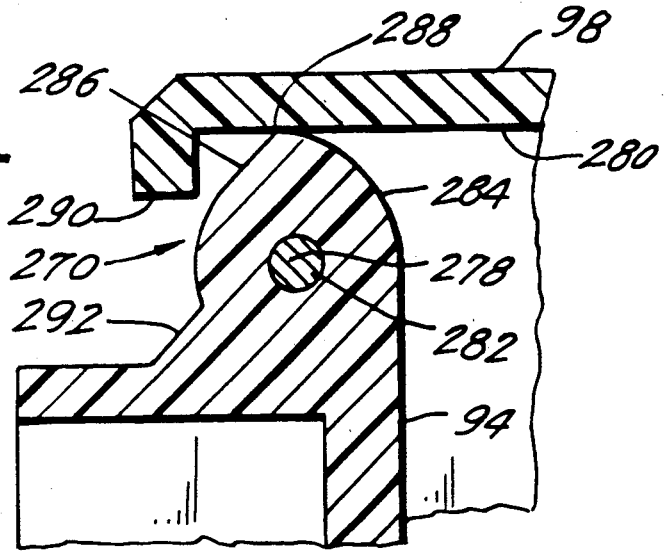
Figure 20:
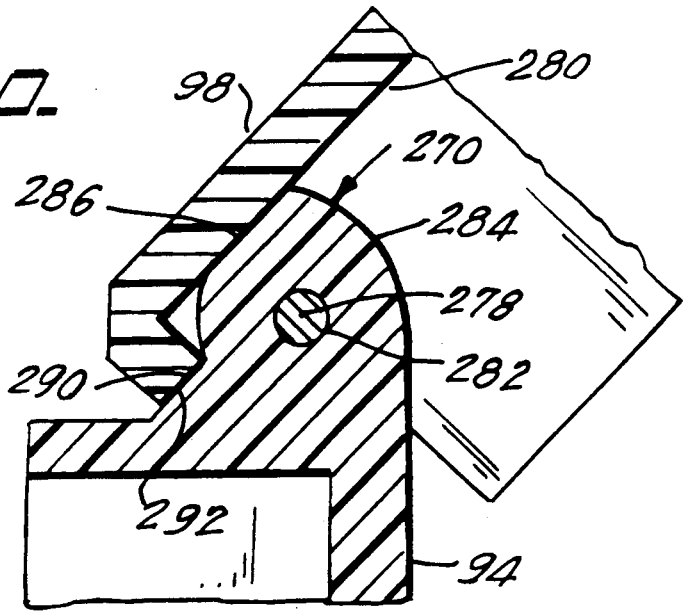
Figure 17:
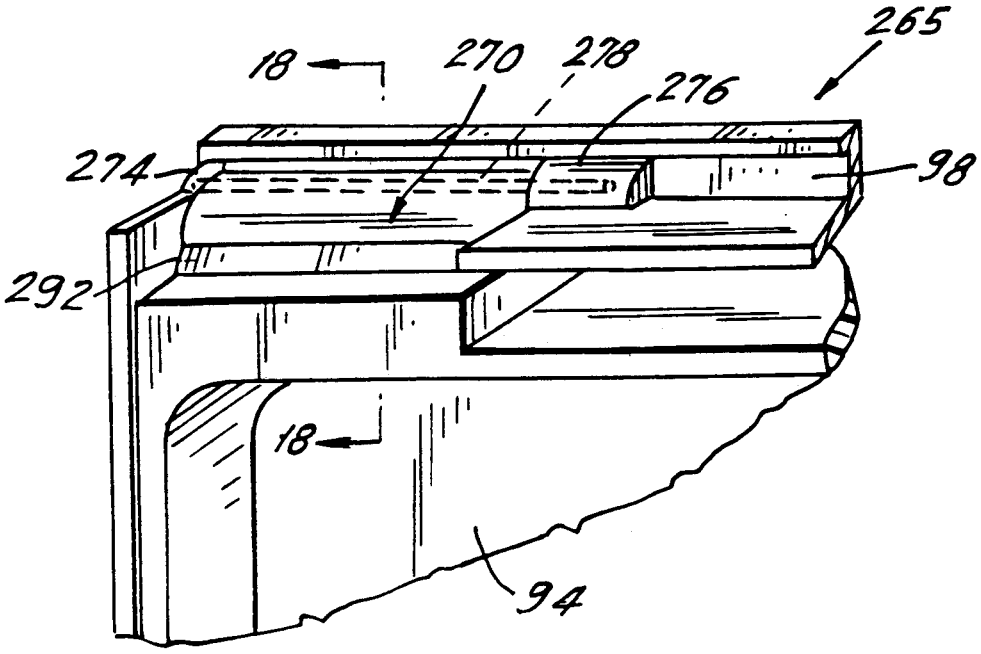
FIG. 17 is a detail perspective view of the hinge of the present invention.
Figure 21:
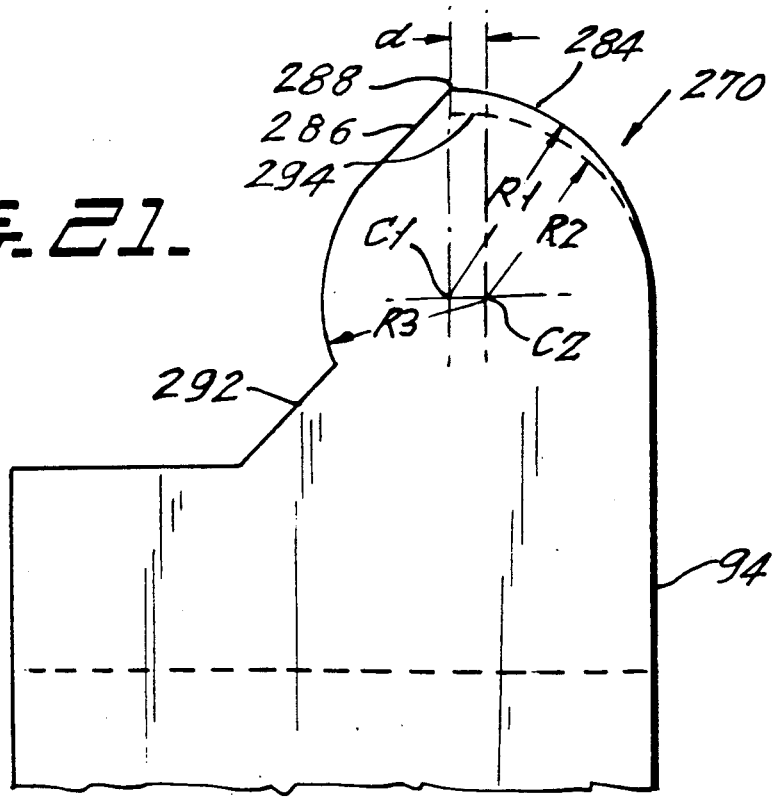
FIG. 21 is a detail view showing the profile of the coupling section forming part of the hinge of the present invention.

The reason that the axial force on inner surface 280 increases as window 98 pivots from the closed position of FIG. 18 to the horizontal position of FIG. 19 resides in the profile of coupling section 270 relative to the location of pin 278. This is best illustrated in FIG. 21. As shown therein, cam surface 284 is cut along a radius R1 which is centered on center C1. Center C1 is horizontally displaced from the center C2, which is the center of pin 278, by a distance d. The nominal distance from the center C2 of pin 278 to the inner surface 280 of window 98 is a radius $R2=R1-d$. When window 98 is in the closed position (FIG. 18) the distal ends of radii R1 and R2 coincide.

As window 98 is moved towards the open position, the inner surface 280 of window 98 attempts to follow the path 294 shown in dashed lines in FIG. 21. Since the cam surface 284 is located above this path, the inner surface 280 of window 98 cannot follow this path. The window 98 actually rides on the outer cam surface 284 due to the flexibility of pin 278 and window 98. The flexing of these elements, however, creates a radially inward force on window 98 in the direction of center C2. Since the distance between cam surface 284 and the nominal path of movement 294 of the inner surface 280 increases as the window 98 is rotated from the closed to the open position, the radially inward force increases to a maximum value at the ridge 288. As the window is pivoted further in the counter clockwise direction, this force snaps the inner surface 280 of window 98 downwardly against the locking surface 286 which is preferably formed at a 45° angle and intersects cam surface 284 at a point horizontally above C1. As a result, window 98 will lock in the open position until such time as the operator forcefully returns it to the closed position.

Figure 22:
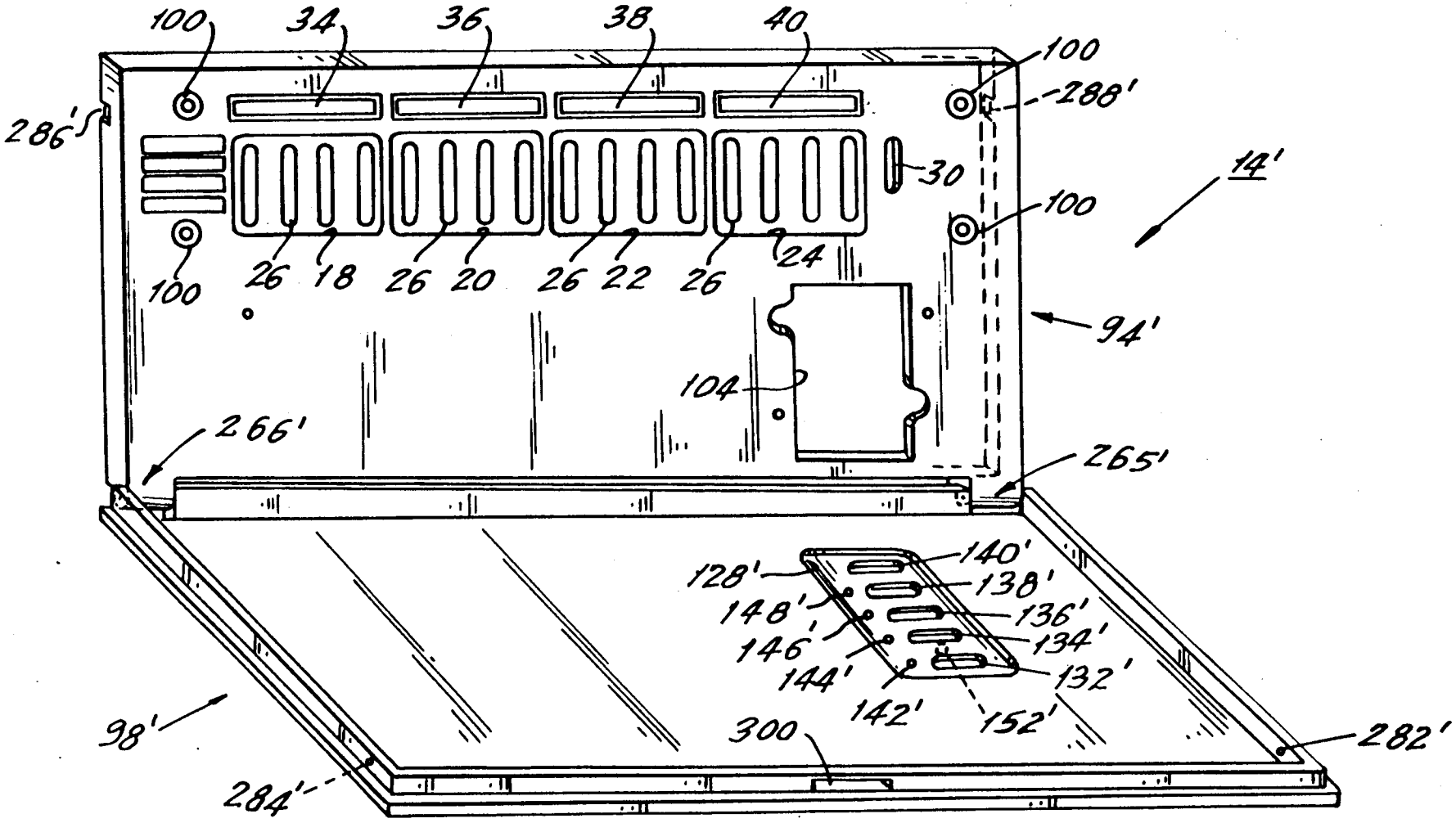
FIG. 22 is a perspective view of a modified version of the face plate assembly.

An alternative embodiment of the face plate assembly is illustrated in FIG. 22 and designated generally as 14'. Elements of this embodiment which are identical to those of the embodiment of FIG. 4 are identified by the same numbers. Elements of the embodiment of FIG. 22 which have been modified but correspond to those of FIG. 4, have been indicated by the same number followed by a prime.

The primary differences between the embodiment of FIG. 4 and that of FIG. 22 are that the switch plate 96 and window 98 of FIG. 4 have been combined into a single window 98' in FIG. 22 and the window 98' is hinged to the bottom of support plate 94' rather than to the top thereof. Window 98' is hinged to support plate 94 by hinges 265' and 266' which are identical to the hinges 265 and 266 in FIG. 3 but are located on the bottom, rather than the top of the support plate.

Since the switch plate 96 has been combined with the window 98' in the embodiment of FIG. 22, the recess 128 and corresponding chamferred openings 132–152 of FIG. 4 have been formed directly in the window 98' of FIG. 22 and are identified as elements 128' and 132'–152', respectively.

The position of the dimples 282', 284' and corresponding recesses 286', 288' have also been moved to a position near the top of support plate 14'. The cooperation between dimples 282', 284' and recesses 286', 288' will maintain the window 98' in the closed position in which it covers and fully encompasses the support plate 14'. When an operator of the dimming assembly 10 wishes to obtain access to the slide control arms of the potentiometers associated with scene control groups 18–24, the operator pulls window 98' into the lower position illustrated in FIG. 22. Window 98 remains in this generally horizontal position due to the operation of the hinges described in detail above. In order to make it easier for the operator to pull the C window 98' down, and further to identify the side of the window 98' which is to be pulled away from the support plate 94', a detent 300 is preferably formed in the top edge of window 98.

The present invention may be embodied in other specific forms without departing from the spirit or essential attributes thereof and, accordingly, reference should be made to the appended claims, rather than to the foregoing specification, as indicating the scope of the invention.

What is claimed is:

1. A face plate with indicator lamp, comprising:
a face plate formed of a generally opaque material and having front and rear surfaces;
a recess formed in said face plate;
a section of material disposed in said recess;
lamp means located adjacent said section of material located in said recess for directing light at said section of material;
said section of material having a light opacity and the intensity of light generated by said lamp means being such that light generated by said lamp means is capable of being seen from a position in front of said front surface when said lamp means is on and said recess providing a light indication having a shape which is essentially determined by the shape of said recess.

2. The face plate of claim 1, wherein said recess extends from said rear surface to a position spaced from said front surface and said section of material is comprised of a relatively thin section of material remaining adjacent said front surface.

3. A face plate with indicator lamp, comprising:
a face plate formed of a generally opaque material and having front and rear surfaces;
a recess formed in said face plate;
a section of material disposed in said recess;
lamp means located adjacent said section of material located in said recess for directing light at said section of material;
said section of material having a light opacity and the intensity of light generated by said lamp means being such that light generated by said lamp means is capable of being seen from a position in front of said front surface when said lamp means is on;
said recess extending from said rear surface to a position spaced from said front surface and said section of material being comprised of a relatively thin section of material remaining adjacent said front surface; and
said thin section of material being constituted of the generally opaque material of said face plate.

4. A face plate with indicator lamp, comprising:
a face plate formed of a generally opaque material and having front and rear surfaces;
a recess formed in said face plate;
a section of material disposed in said recess;
lamp means located adjacent said section of material located in said recess for directing light at said section of material;
said section of material having a light opacity and the intensity of light generated by said lamp means being such that light generated by said lamp means is capable of being seen from a position in front of said front surface when said lamp means is on;
said recess extending from said rear surface to a position spaced from said front surface and said section of material being comprised of a relatively thin section of material remaining adjacent said front surface; and
said thin section of material being constituted of a material which is optically less dense than said generally opaque material of said face plate.

5. The face plate of claim 4, wherein said optically less dense material is of a type which diffuses light.

6. The face plate of claim 4, wherein said thin section of material is formed by a partial backfilling, with said optically less dense material, of a through-going recess formed in said face plate.

7. A face plate with indicator lamp, comprising:
a face plate formed of a generally opaque material and having front and rear surfaces;
a recess formed in said face plate;
a section of material disposed in said recess;
lamp means located adjacent said section of material located in said recess for directing light at said section of material;
said section of material having a light opacity and the intensity of light generated by said lamp means being such that light generated by said lamp means is capable of being seen from a position in front of said front surface when said lamp means is on;
said recess extending from said rear surface to a position spaced from said front surface and said section of material being comprised of a relatively thin section of material remaining adjacent said front surface; and
said thin section of material being constituted by a first region of material formed of said generally opaque material of said face plate and a second region of material which is constituted of a material which is optically less dense than said generally opaque material of said face plate and wherein said first and second regions of material are superposed.

8. The face plate of claim 2, wherein said recess is generally cylindrically shaped.

9. The face plate of claim 2, wherein said recess is annularly shaped.

10. A face plate with indicator lamp, comprising:
a face plate formed of a generally opaque material and having front and rear surfaces;
a recess formed in said face plate;
a section of material disposed in said recess;
lamp means located adjacent said section of material located in said recess for directing light at said section of material;
said section of material having a light opacity and the intensity of light generated by said lamp means being such that light generated by said lamp means is capable of being seen from a position in front of said front surface when said lamp means is on;
said recess extending from said rear surface to a position spaced from said front surface and said section of material being comprised of a relatively thin section of material remaining adjacent said front surface; and
wherein the front surface of said face plate overlying said recess is treated to diffuse the light passing through said front surface overlying said recess.

11. A face plate with indicator lamp, comprising:
a face plate formed of a generally opaque material and having front and rear surfaces;
a recess formed in said face plate;

a section of material disposed in said recess;

lamp means located adjacent said section of material located in said recess for directing light at said section of material;

said section of material having a light opacity and the intensity of light generated by said lamp means being such that light generated by said lamp means is capable of being seen from a position in front of said front surface when said lamp means is on;

said recess extending from said rear surface to a position spaced from said front surface and said section of material being comprised of a relatively thin section of material remaining adjacent said front surface; and wherein the front surface of said face plate overlying said recess is provided with at least one annular V-shaped groove therein.

12. The face plate of claim 2, further comprising a continuously variable dimmer for controlling the light intensity of said lamp means and a dimming adjusting member for controlling said dimmer.

13. The face plate of claim 12, wherein said dimming adjusting member comprises a linearly movable adjustment lever.

14. The face plate of claim 12, wherein said dimming adjusting member comprises a rotary knob.

15. The face plate of claim 12, wherein said dimming adjusting member comprises a screw adjustment.

16. The face plate of claim 12, wherein said dimming adjusting member is hidden.

17. A face plate with indicator lamp, comprising:

a face plate formed of a generally opaque material and having front and rear surfaces;

a recess formed in said face plate;

a section of material disposed in said recess;

lamp means located adjacent said section of material located in said recess for directing light at said section of material;

said section of material having a light opacity and the intensity of light generated by said lamp means being such that light generated by said lamp means is capable of being seen from a position in front of said front surface when said lamp means is on;

said recess extending from said rear surface to a position spaced from said front surface and said section of material being comprised of a relatively thin section of material remaining adjacent said front surface; and further comprising mechanical dimmer means disposed between said lamp means and said thin section of material for controlling the intensity of light provided by said lamp means to said thin section of material.

18. The face plate of claim 17, wherein said mechanical dimmer means comprises a variable density filter.

19. The face plate of claim 1, wherein said recess is a through-going recess and wherein said section of material is formed by the filling of substantially the entirety of said through-going recess with a material which is optically less dense than said generally opaque material of said face plate.

20. The face plate of claim 19, wherein said through-going recess is generally cylindrically shaped.

21. The face plate of claim 19, wherein said through-going recess is annularly shaped.

22. A face plate with indicator lamp, comprising:

a face plate formed of a generally opaque material and having front and rear surfaces;

a recess formed in said face plate;

a section of material disposed in said recess;

lamp means located adjacent said section of material located in said recess for directing light at said section of material;

said section of material having a light opacity and the intensity of light generated by said lamp means being such that light generated by said lamp means is capable of being seen from a position in front of said front surface when said lamp means is on;

said recess being a through-going recess and said section of material being formed by the filling of substantially the entirety of said through-going recess with a material which is optically less dense than said generally opaque material of said face plate; and wherein the front surface of said optically less dense material is treated to diffuse the light passing through said front surface overlying said recess.

23. A face plate with indicator lamp, comprising:

a face plate formed of a generally opaque material and having front and rear surfaces;

a recess formed in said face plate;

a section of material disposed in said recess;

lamp means located adjacent said section of material located in said recess for directing light at said section of material;

said section of material having a light opacity and the intensity of light generated by said lamp means being such that light generated by said lamp means is capable of being seen from a position in front of said front surface when said lamp means is on;

said recess being a through-going recess and said section of material being formed by the filling of substantially the entirety of said through-going recess with a material which is optically less dense than said generally opaque material of said face plate; and said optically less dense material being of a type which diffuses light.

24. A face plate with indicator lamp, comprising:

a face plate formed of a generally opaque material and having front and rear surfaces;

a recess formed in said face plate;

a section of material disposed in said recess;

lamp means located adjacent said section of material located in said recess for directing light at said section of material;

said section of material having a light opacity and the intensity of light generated by said lamp means being such that light generated by said lamp means is capable of being seen from a position in front of said front surface when said lamp means is on;

said recess being a through-going recess and said section of material being formed by the filling of substantially the entirety of said through-going recess with a material which is optically less dense than said generally opaque material of said face plate; and the front surface of said optically less dense material being provided with at least one annular V-shaped groove therein.

25. The face plate of claim 19, further comprising a continuously variable dimmer for controlling the light intensity of said lamp means and a dimming adjusting member for controlling said dimmer.

26. The face plate of claim 25, wherein said dimming adjusting member comprises a linearly movable adjustment lever.

27. The face plate of claim 25, wherein said dimming adjusting member comprises a rotary knob.

28. The face plate of claim 25, wherein said dimming adjusting member comprises a screw adjustment.

29. The face plate of claim 25, wherein said dimming adjusting member is hidden.

30. A face plate with indicator lamp, comprising:

face plate formed of a generally opaque material and having front and rear surfaces;

a recess formed in said face plate;

a section of material disposed in said recess;

lamp means located adjacent said section of material located in said recess for directing light at said section of material;

said section of material having a light opacity and the intensity of light generated by said lamp means being such that light generated by said lamp means is capable of being seen from a position in front of said front surface when said lamp means is on;

said recess being a through-going recess and said section of material being formed by the filling of substantially the entirety of said through-going recess with a material which is optically less dense than said generally opaque material of said face plate; and further comprising mechanical dimmer means disposed between said lamp means and said through-going recess.

31. The face plate of claim 30, wherein said mechanical dimmer means comprises a variable density filter.

32. A face plate assembly for a dimmer assembly, said face plate assembly comprising:

a support plate having an opening formed therein through which a moveable control member can extend; said support plate including a coupling section having a cam surface and a locking surface which intersect at a ridge;

a window pivotally coupled to said coupling section of said support plate by a pin and being pivotable about an axis of said pin between a closed position, wherein said window covers said opening in said support plate, and an open position wherein said window exposes said opening in said support plate, an inner surface of said window sliding along said cam surface as said window moves from said closed position to said open position until it reaches said ridge and then contacting said locking surface after it moves past said ridge, said window covering approximately the top half of said support plate when it is in said closed position;

said coupling section, said window and said pin cooperating to cause said inner surface to be biased radially inward towards said axis of said pin in such a manner that said inner surface is first biased into contact with said cam surface and is then biased into locking engagement with said locking surface as said window is moved form said closed to said open position;

a face plate formed of a generally opaque material and having front and rear surfaces and covering approximately the bottom half of said support plate;

a recess formed in said face plate, said recess extending from said rear surface to a position spaced from said front surface and a relatively thin section of material remaining adjacent said front surface; and lamp means located adjacent said rear surface in the area of said recess for directing light at said thin section of material; and the thickness and opacity of said thin section of material and the intensity of light generated by said lamp means being such that light generated by said lamp means is capable of being seen from a position in front of said front surface when said lamp means is on.

33. The face plate assembly of claim 32, wherein said thin section of material is constituted of the generally opaque material of said face plate.

34. The face plate assembly of claim 32, wherein said thin section of material is constituted by a material which is optically less dense than said generally opaque material of said face plate.

35. The face plate assembly of claim 32, wherein the front surface of said face plate overlying said recess is treated to diffuse the light passing through said front surface overlying said recess.

36. The face plate assembly of claim 32, further comprising a dimming adjusting member for controlling dimming of light produced by said lamp means.

* * * * *